US006196949B1

(12) United States Patent
Rodarte

(10) Patent No.: US 6,196,949 B1
(45) Date of Patent: Mar. 6, 2001

(54) APPARATUS FOR ASSISTING AND TRAINING A CHILD TO WALK

(76) Inventor: Ruben Rodarte, P.O. Box 31721, Amarillo, TX (US) 79120

( * ) Notice: Subject to any disclaimer, the term of this patent is extended or adjusted under 35 U.S.C. 154(b) by 0 days.

(21) Appl. No.: 09/243,077

(22) Filed: Feb. 2, 1999

(51) Int. Cl.[7] ..... A47D 13/04; A61H 3/00

(52) U.S. Cl. ..... 482/69; 482/51; 482/143; 434/255

(58) Field of Search ..... 482/41, 43, 51, 482/143, 66–69, 907; 434/247, 255; 294/140, 167–169; 248/284.1, 324; 211/2, 113, 123; D12/130; 606/240

(56) References Cited

U.S. PATENT DOCUMENTS

| | | | | |
|---|---|---|---|---|
| D. 360,855 | * | 8/1995 | Jameson et al. | D12/130 |
| 1,193,374 | * | 8/1916 | Gilliam | 482/69 |
| 1,332,461 | * | 3/1920 | Bowden | 482/51 |
| 1,757,784 | * | 5/1930 | Smoot | 482/67 |
| 2,108,566 | * | 2/1938 | Sanders | 482/69 |
| 2,545,009 | * | 3/1951 | Spiteri | 482/51 |
| 2,956,616 | * | 10/1960 | Labusky et al. | 482/69 |
| 3,237,939 | * | 3/1966 | Olivet et al. | 482/69 |
| 3,568,226 | * | 3/1971 | Mater et al. | 482/67 |
| 3,778,052 | * | 12/1973 | Andow et al. | 482/67 |
| 4,256,098 | * | 3/1981 | Swan et al. | 482/69 |
| 4,895,328 | * | 1/1990 | Ryan | 248/124.1 |
| 4,907,571 | * | 3/1990 | Futakami | 482/69 |
| 5,120,287 | * | 6/1992 | Brown et al. | 482/69 |
| 5,165,436 | * | 11/1992 | Hall, Sr. et al. | 135/68 |
| 5,325,550 | * | 7/1994 | Dearstyne | 5/89.1 |
| 5,667,265 | * | 9/1997 | Gebhard | 294/169 |

* cited by examiner

*Primary Examiner*—Glenn E. Richman
*Assistant Examiner*—Victor K. Hwang
(74) *Attorney, Agent, or Firm*—Samuel Brown Silverman

(57) ABSTRACT

The present invention, in certain embodiments, a portable structure for supporting infants for the purpose of training and assisting infants to walk. The structure comprises a frame, generally U-shaped at the top with at least one J-shaped leg element being attached to the frame, with the J-shaped leg elements being parallel to each other, and with the J-shaped leg elements being padded. The frame may be made of a light-weight material, such as aluminum or steel tubing, wood or plastic, and the padding is made of a flexible, yet durable impact-absorbing material. The structure may further include a wheeled extension member attached to either the top of the frame or to one or more of the J-shaped leg elements.

15 Claims, 5 Drawing Sheets

APPARATUS FOR ASSISTING AND TRAINING A CHILD TO WALK

BACKGROUND OF THE INVENTION

1. Field of the Invention

The present invention is directed to portable structures for supporting infants, and in one aspect to such structures for training and assisting infants in walking.

2. Description of the Related Art

Certain prior art devices for assisting an infant to walk or increase mobility by using his or her legs generally include wheeled carts which suspend the child in a lower-body harness or other suspension means in order for the child's legs to reach the travelling surface. These devices are generally used more for entertainment purposes than for training the child to walk. To the extent the currently available art is used for training purposes, they do not require the attention of an adult, and as a result, both direct interaction with and attention to the child is lacking.

A variety of prior art patents disclose an adult-operated child suspension means for enabling, teaching, or assisting infants to walk. Certain prior art baby-walking aids that provide overhead suspension means rely upon the child's manually grasping the apparatus for support. U.S. Pat. No. 2,956,616 describes an apparatus operated overhead by an adult holding with two hands a first set of gripping handles whereby the child manually supports itself by grasping a second set of gripping handles located at the bottom ends of a single piece of rigid sheet material.

Other prior art baby-walking aids provide support for the child by means of a support or harness attached to the body of the child. U.S. Pat. No. 2,108,566 describes a staff-controlled baby walker whereby the body of the child is supported by a harness and a rigid staff, which rigid staff is held by an adult operator in a position vertically superior to the child. U.S. Pat. No. 3,237,939 describes an overhead baby walking aid comprising a pair of hand holds to be grasped by a child's hands and finger grips for a single hand of an adult operator to guide the child suspended by a body harness attached to the walking aid.

The prior art also discloses wheeled rigid structures that a child stands in or sits in and in which the child alone may move about.

SUMMARY OF THE INVENTION

Young children learn to walk at different ages. This invention is, in certain embodiments, a portable structure for supporting infants for the purpose of training and assisting infants to walk. The structure, in one aspect, includes a frame, generally U-shaped at the top with two leg elements with each of the frame's two leg elements being generally J-shaped, with the J-shaped leg elements being parallel to each other, and preferably with the J-shaped leg elements being padded. The structure provides a space which allows placement of the child as well as movement of the child's upper torso and head; the child grasps the one or more J-shaped is leg elements for support; alternatively, the child supports itself by positioning its armpits and upper arms on the one or more J-shaped leg elements. The frame, in one aspect, is made of a light-weight material, such as aluminum or steel tubing, wood or plastic, and the padding is made of a flexible, yet durable impact-absorbing material, such as a polystyrene-type foam.

This invention, in one embodiment, is an apparatus for assisting and training a child to walk which includes a frame element with a first end, a second end, and a middle section, and at least one J-shaped leg element with an elongated top end and a curved bottom end, the elongated top end of the at least one J-shaped leg element being attached to an end of the frame element. The middle section of the frame element may include at least one handle. An impact-absorbing material, such as a polystyrene-type foam, may cover the at least one J-shaped leg element.

This invention, in one embodiment, is an apparatus for assisting and training a child to walk which includes a frame element with a first end, a second end and a middle section, and at least one J-shaped leg element with an elongated top end and a curved bottom end, the elongated top end of the at least one J-shaped leg element being attached to an end of the frame element.

This invention, in another embodiment, is an apparatus for assisting and training a child to walk which includes a frame element with a first end, a second end and a middle section, and at least one J-shaped leg element with an elongated top end and a curved bottom end, the elongated top end of the at least one J-shaped leg element being attached to an end of the frame element wherein the curved bottom end of the at least one J-shaped leg element is a closed loop.

This invention, in another embodiment, is an apparatus for assisting and training a child to walk which includes a frame element with a first end, a second end and a middle section, and at least one J-shaped leg element with an elongated top end and a curved bottom end, the elongated top end of the at least one J-shaped leg element being attached to an end of the frame element wherein the curved bottom end of the at least one J-shaped leg element is a nearly closed loop.

This invention, in another embodiment, is an apparatus for assisting and training a child to walk which includes a frame element with a first end, a second end and a middle section, at least one J-shaped leg element with an elongated top end and a curved bottom end, the elongated top end of the at least one J-shaped leg element being attached to an end of the frame element, and at least one extension member connected to and extending from the at least one J-shaped leg element, the at least one extension member contacting a traveling surface for resting or rolling the apparatus on the traveling surface.

This invention, in another embodiment, is an apparatus for assisting and training a child to walk which includes a frame element with a first end, a second end and a middle section, and at least one J-shaped leg element with an elongated top end and a curved bottom end, the elongated top end of the at least one J-shaped leg element being attached to an end of the frame element, and at least one extension member connected to and extending from the frame element, the at least one extension member contacting a traveling surface for resting or rolling the apparatus on the traveling surface.

This invention, in another embodiment, is an apparatus for assisting and training a child to walk which includes a frame element with a first end, a second end and a middle section, and at least one J-shaped leg element with an elongated top end and a curved bottom end, the elongated top end of the at least one J-shaped leg element being attached to an end of the frame element, with at least one handle located on the frame element.

This invention, in another embodiment, is an apparatus for assisting and training a child to walk which includes a frame element with a first end, a second end and a middle section, and at least one J-shaped leg element with an elongated top end and a curved bottom end, the elongated top end of the at least one J-shaped leg element being attached to an end of the frame element, wherein the at least one J-shaped leg element includes a separate elongated generally vertical top end element with a top and a bottom and a separate generally horizontal curved bottom end element with a front end and a rear end, the front end of the separate generally horizontal curved bottom end element of the J-shaped leg element pivotally attached to the bottom of the separate elongated generally vertical top end element, and the separate generally horizontal curved bottom end element of the J-shaped leg element folding into the separate elongated generally vertical top end element.

This invention, in another embodiment, is an apparatus for assisting and training a child to walk which includes a frame element with a first end, a second end and a middle section, and at least one J-shaped leg element with an elongated top end and a curved bottom end, the elongated top end of the at least one J-shaped leg element being attached to an end of the frame element, wherein the elongated top end of the at least one J-shaped leg element is extensible and includes a first shaft, a movable second shaft which fits into and moves within the first shaft, and a means to secure the first shaft and the second shaft together to alter the length of the elongated top end of the at least one J-shaped leg element.

This invention, in another embodiment, is an apparatus for assisting and training a child to walk which includes a frame element with a first end, a second end and a middle section, and at least one J-shaped leg element with an elongated top end and a curved bottom end, the elongated top end of the at least one J-shaped leg element being attached to an end of the frame element, wherein the at least one J-shaped leg element has an exterior surface and wherein an impact-absorbing material lines the exterior surface of the at least one J-shaped leg element.

This invention, in another embodiment, is an apparatus for assisting and training a child to walk which includes a frame element with a first end, a second end and a middle section, and at least one J-shaped leg element with an elongated top end and a curved bottom end, the elongated top end of the at least one J-shaped leg element being attached to an end of the frame element, wherein the at least one J-shaped leg element has an exterior surface and wherein an impact-absorbing material lines the exterior surface of the curved bottom end of the at least one J-shaped leg element.

This invention, in another embodiment, is an apparatus for assisting and training a child to walk which includes a frame element with a first end, a second end and a middle section, and at least one J-shaped leg element with an elongated top end and a curved bottom end, the elongated top end of the at least one J-shaped leg element being attached to an end of the frame element, wherein the at least one J-shaped leg element includes a first J-shaped leg element and a second J-shaped leg element, each J-shaped leg element defining a plane, and the elongated top end of the first J-shaped leg element attached to the first end of the frame element and generally positioned perpendicular to the middle section of the frame element, and the elongated top end of the second J-shaped leg element attached to the second end of the frame element and generally positioned perpendicular to the middle section of the frame element, and the two J-shaped leg elements positioned symmetrically opposed to each other with respect to a plane normal to a longitudinal axis of the middle section of the frame element, and the planes defined by the two J-shaped leg elements generally parallel both to each other and to the plane normal to the longitudinal axis of the middle section of the frame element.

This invention, in another embodiment, is an apparatus for assisting and training a child to walk which includes a frame element with a first end, a second end and a middle section, and at least one J-shaped leg element with an elongated top end and a curved bottom end, the elongated top end of the at least one J-shaped leg element being attached to an end of the frame element, wherein the at least one J-shaped leg element includes a first J-shaped leg element and a second J-shaped leg element, each J-shaped leg element defining a plane, and the elongated top end of the first J-shaped leg element attached to the first end of the frame element and generally positioned perpendicular to the middle section of the frame element, and the elongated top end of the second J-shaped leg element attached to the second end of the frame element and generally positioned perpendicular to the middle section of the frame element, and the two J-shaped leg elements positioned symmetrically opposed to each other with respect to a plane normal to a longitudinal axis of the middle section of the frame element, and the planes defined by the two J-shaped leg elements generally parallel both to each other and to the plane normal to the longitudinal axis of the middle section of the frame element, wherein the frame and J-shaped leg elements define a space to permit movement of the child's upper torso and head within the space defined by the apparatus.

This invention, in another embodiment, is an apparatus for assisting and training a child to walk which includes a frame element with a first end, a second end and a middle section with at least one handle located on the frame element, and at least one J-shaped leg element with an elongated top end and a curved bottom end, the elongated top end of the at least one J-shaped leg element being attached to an end of the frame element, wherein the at least one J-shaped leg element includes a first J-shaped leg element and a second J-shaped leg element, each J-shaped leg element defining a plane, and the elongated top end of the first J-shaped leg element attached to the first end of the frame element and generally positioned perpendicular to the middle section of the frame element, and the elongated top end of the second J-shaped leg element attached to the second end of the frame element and generally positioned perpendicular to the middle section of the frame element, and the two J-shaped leg elements positioned symmetrically opposed to each other with respect to a plane normal to a longitudinal axis of the middle section of the frame element, and the planes defined by the two J-shaped leg elements generally parallel both to each other and to the plane normal to the longitudinal axis of the middle section of the frame element.

This invention, in another embodiment, is an apparatus for assisting and training a child to walk which includes a frame element with a first end, a second end and a middle section, and at least one J-shaped leg element with an elongated top end and a curved bottom end, the elongated top end of the at least one J-shaped leg element being attached to an end of the frame element, wherein the at least one J-shaped leg element includes a first J-shaped leg element and a second J-shaped leg element, each J-shaped leg element defining a plane, and the elongated top end of the first J-shaped leg element attached to the first end of the frame element and generally positioned perpendicular to the middle section of the frame element, and the elongated top end of the second J-shaped leg element attached to the second end of the frame element and generally positioned perpendicular to the middle section of the frame element, and the two J-shaped leg elements positioned symmetrically opposed to each other with respect to a plane normal to a longitudinal axis of the middle section of the frame element, and the planes defined by the two J-shaped leg elements generally parallel both to each other and to the plane normal to the longitudinal axis of the middle section of the frame element. Each J-shaped leg element includes a separate elongated generally vertical top end element with a top and a bottom and a corresponding separate generally horizontal curved bottom end element with a front end and a rear end, the front end of the corresponding separate generally horizontal curved bottom end element of each J-shaped leg element pivotally attached to the bottom of the separate elongated generally vertical top end element, the corresponding separate generally horizontal curved bottom end element of each J-shaped leg element folding into the separate elongated generally vertical top end element of each J-shaped leg element.

This invention, in another embodiment, is an apparatus for assisting and training a child to walk which includes a frame element with a first end, a second end and a middle section, and at least one J-shaped leg element with an elongated top end and a curved bottom end, the elongated top end of the at least one J-shaped leg element being attached to an end of the frame element, wherein the at least one J-shaped leg element includes a first J-shaped leg element and a second J-shaped leg element, each J-shaped leg element defining a plane, and the elongated top end of the first J-shaped leg element attached to the first end of the frame element and generally positioned perpendicular to the middle section of the frame element, and the elongated top end of the second J-shaped leg element attached to the second end of the frame element and generally positioned perpendicular to the middle section of the frame element, and the two J-shaped leg elements positioned symmetrically opposed to each other with respect to a plane normal to a longitudinal cross section of the middle section of the frame element, and the planes defined by the two J-shaped leg elements generally parallel both to each other and to the plane normal to the longitudinal cross section of the middle section of the frame element, wherein the elongated top end of each J-shaped leg element is extensible and comprises a first shaft, a movable second shaft which fits into and moves within the first shaft, and a means to secure the first shaft and the second shaft together to alter the length of the elongated top end of each J-shaped leg element.

This invention, in another embodiment, is an apparatus for assisting and training a child to walk which includes a frame element, with a first end, a second end and a middle section with at least one handle located along the middle section of the frame element, and at least one J-shaped leg element with an elongated top end and a curved bottom end, the elongated top end of the at least one J-shaped leg element being attached to an end of the frame element, wherein the at least one J-shaped leg element includes a first J-shaped leg element and a second J-shaped leg element, each J-shaped leg element defining a plane, and the elongated top end of the first J-shaped leg element attached to the first end of the frame element and generally positioned perpendicular to the middle section of the frame element, and the elongated top end of the second J-shaped leg element attached to the second end of the frame element and generally positioned perpendicular to the middle section of the frame element, and the two J-shaped leg elements positioned symmetrically opposed to each other with respect to a plane normal to a longitudinal cross section of the middle section of the frame element, and the planes defined by the two J-shaped leg elements generally parallel both to each other and to the plane normal to the longitudinal cross section of the middle section of the frame element, wherein each J-shaped leg element has an exterior surface and wherein an impact-absorbing material lines the exterior surface of each J-shaped leg element.

This invention, in another embodiment, is an apparatus for assisting and training a child to walk which includes a frame element, with a first end, a second end and a middle section with at least one handle located along the middle section of the frame element, and at least one J-shaped leg element with an elongated top end and a curved bottom end, the elongated top end of the at least one J-shaped leg element being attached to an end of the frame element, wherein the at least one J-shaped leg element includes a first J-shaped leg element and a second J-shaped leg element, each J-shaped leg element defining a plane, and the elongated top end of the first J-shaped leg element attached to the first end of the frame element and generally positioned perpendicular to the middle section of the frame element, and the elongated top end of the second J-shaped leg element attached to the second end of the frame element and generally positioned perpendicular to the middle section of the frame element, and the two J-shaped leg elements positioned symmetrically opposed to each other with respect to a plane normal to a longitudinal cross section of the middle section of the frame element, and the planes defined by the two J-shaped leg elements generally parallel both to each other and to the plane normal to the longitudinal cross section of the middle section of the frame element, wherein each J-shaped leg element has an exterior surface and wherein an impact-absorbing material lines the exterior surface of the curved bottom end of each J-shaped leg element.

This invention, in another embodiment, is an apparatus for assisting and training a child to walk including a frame element, with a first end, a second end and a middle section, at least one J-shaped leg element with an elongated top end and a curved bottom end, the elongated top end of the at least one J-shaped leg element being attached to an end of the frame element, at least one handle located along the middle section of the frame element, and an impact-absorbing material covering the at least one J-shaped leg element.

This invention, in another embodiment, is an apparatus for assisting and training a child to walk including a first J-shaped leg element with an elongated top end with a first engagement portion and a first curved bottom end for positioning beneath a first arm of a child, and a second J-shaped leg element with an elongated top end with a second engagement portion for engaging the first engagement portion and a second curved bottom end for positioning beneath a second arm of the child.

This invention, in another embodiment, is an apparatus for assisting and training a child to walk including a first J-shaped leg element with an elongated top end with a first engagement portion and a first curved bottom end for positioning beneath a first arm of a child, and a second J-shaped leg element with an elongated top end with a second engagement portion for releasably engaging the first engagement portion and a second curved bottom end for positioning beneath a second arm of the child wherein the first engagement portion and the second engagement portion are hooks.

This invention, in another embodiment, is an apparatus for assisting and training a child to walk including a first J-shaped leg element with an elongated top end with a first engagement portion and a first curved bottom end for positioning beneath a first arm of a child, and a second J-shaped leg element with an elongated top end with a second engagement portion for releasably engaging the first engagement portion and a second curved bottom end for positioning beneath a second arm of the child wherein the first engagement portion is threaded to receive and mate with the second engagement portion which is also threaded.

This invention, in another embodiment, is an apparatus for assisting and training a child to walk including a first J-shaped leg element with an elongated top end with a first engagement portion and a first curved bottom end for positioning beneath a first arm of a child, and a second J-shaped leg element with an elongated top end with a second engagement portion for releasably engaging the first engagement portion and a second curved bottom end for positioning beneath a second arm of the child.

This invention, in another embodiment, is an apparatus for assisting and training a child to walk including a first J-shaped leg element with an elongated top end with a first engagement portion and a first curved bottom end for positioning beneath a first arm of a child, and a second J-shaped leg element with an elongated top end with a second engagement portion for engaging the first engagement portion and a second curved bottom end for positioning beneath a second arm of the child.

This invention, in another embodiment, is a method for training a child to walk, the child having a head, a body, hands, forearms and upper arms, the method including positioning the child in contact with an apparatus for assisting and training a child to walk, said apparatus comprising a frame element, with a first end, a second end and a middle section and at least one J-shaped leg element with an elongated top end and a curved bottom end, the elongated top end of the at least one J-shaped leg element being attached to an end of the frame element, suspending the frame over the head of the child and around the body of the child to permit movement of the child's upper torso and head within the space defined by the apparatus so that the elongated top end of the at least one J-shaped leg element is adjacent to the child's hands, and the curved bottom end of the at least one J-shaped leg element is beneath the forearms and upper arms of the child, and placing the hands of the child on the frame, the child supporting itself with its forearms and upper arms, the child leaning on the lower part of the at least one J-shaped leg element while attempting to walk.

DESCRIPTION OF THE PREFERRED EMBODIMENTS

Figure 1:
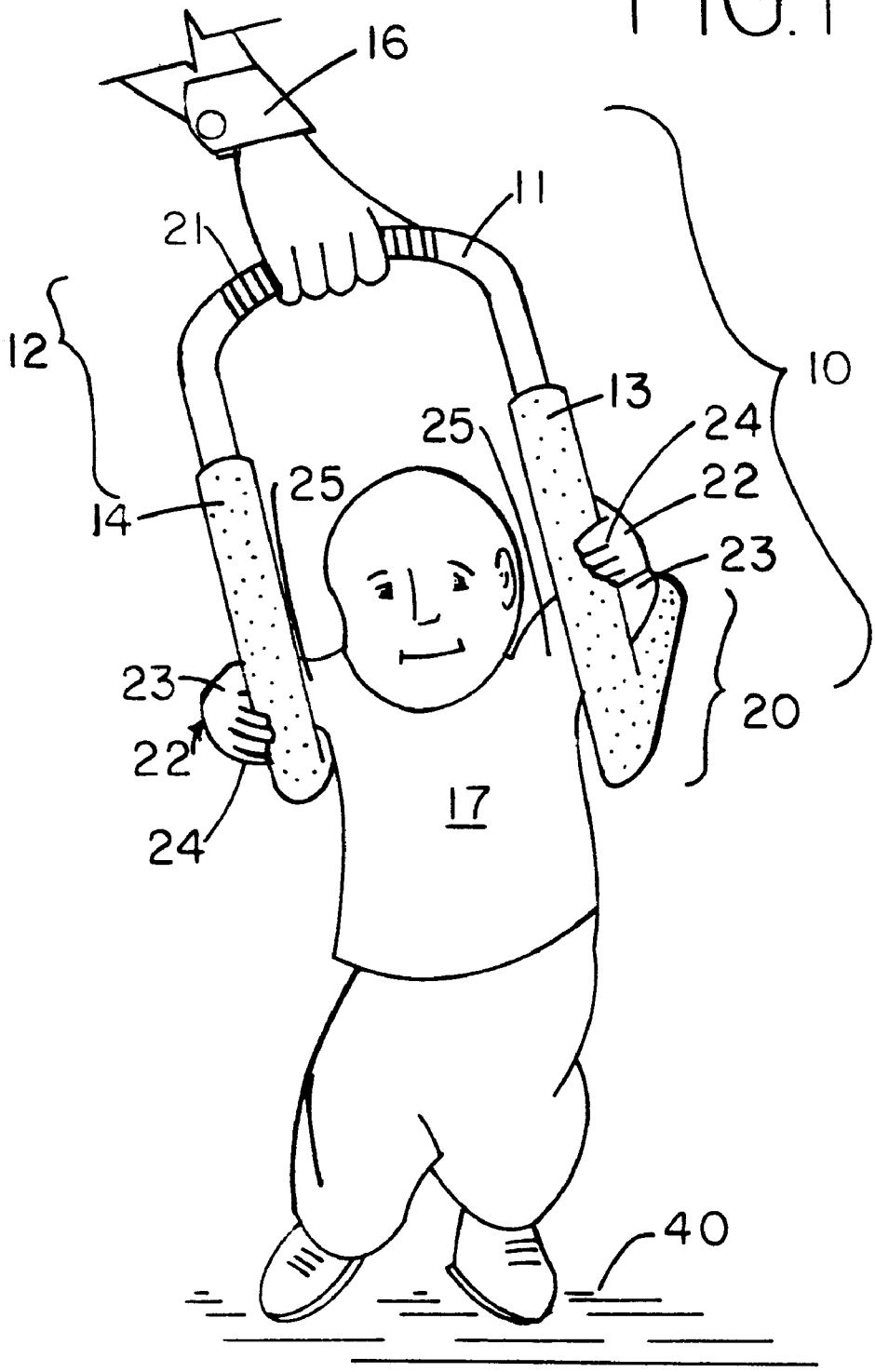
FIG. 1 is an oblique view of an infant walking and training apparatus according to the present invention in use: an adult operator who holds the apparatus, which apparatus is supporting a child who is training to walk, and the child is holding and supporting itself upon the suspended apparatus.
Figure 2:
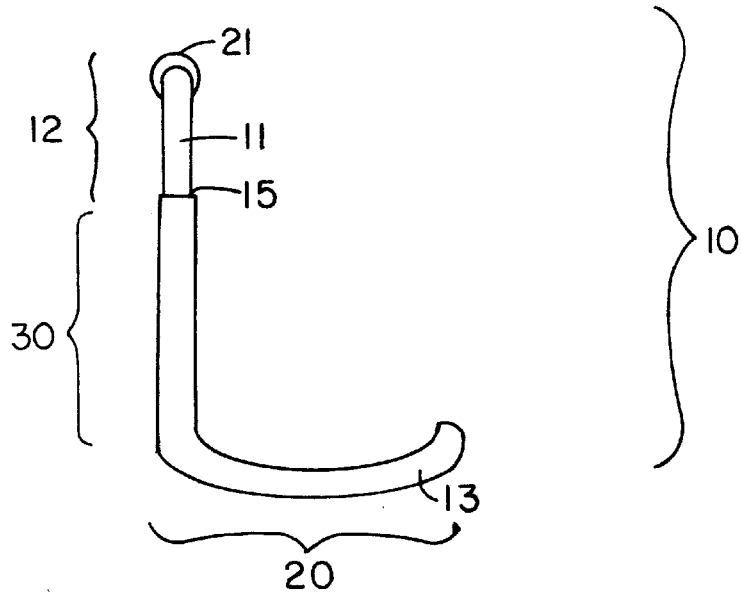
FIG. 2 is a side view of the infant walking and training apparatus of FIG. 1.
Figure 3:
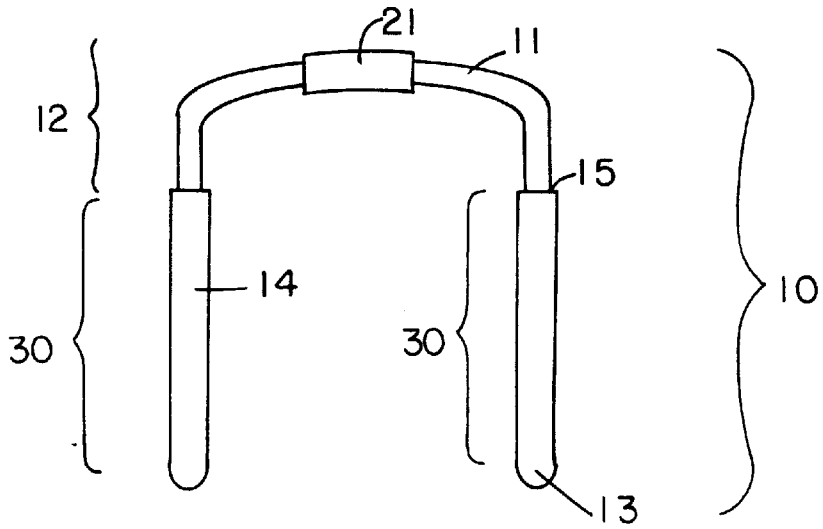
FIG. 3 is a front view of the infant walking and training apparatus of FIG. 1.
Figure 4:
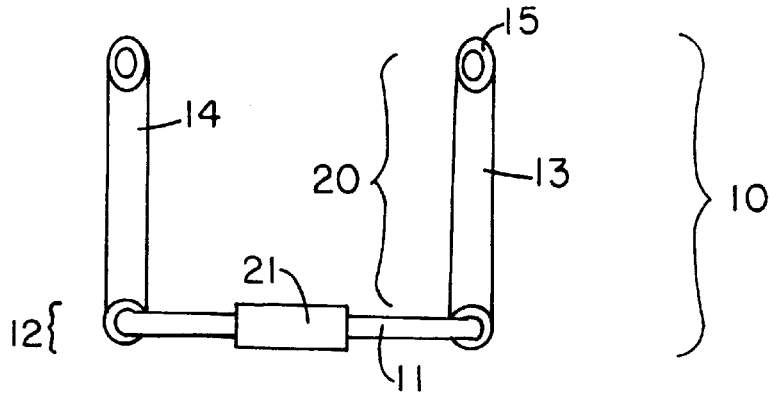
FIG. 4 is a top view of the infant walking and training apparatus of FIG. 1.

This invention, in various embodiments, is a portable structure for use by one or more operators in supporting infants for the purpose of training and assisting infants to walk. The infant walking and training apparatus (10) comprises a frame (11) with a top (12), the frame being generally U-shaped at the top (12), the top (12) having two ends, and with two leg elements (13 & 14), each leg element having an elongated and generally vertical top end element (30) and a lower portion (20). The top end element (30) of each leg element (13 & 14) is attached to an end of the top (12) of the frame (11). The two leg elements (13 & 14) are each generally J-shaped and padded along the lower portions (20) of the leg elements (13 & 14). The generally J-shaped leg elements (13 & 14) are parallel to each other. The frame (11), comprising the top (12) and leg elements (13 & 14), is made of a rigid light-weight material, such as aluminum or steel tubing, plastic or wood, and padding (15), attached to the exterior of lower portions (20) is made of a flexible, yet durable impact-absorbing material, such as polystyrene-type foam. When in use, an operator (16), who is in a generally upright, standing, erect or walking position, holds the frame (11) by a handle or grip (21), which handle or grip (21) is attached to, or part of, top (12). The operator (16) manually suspends the frame (11) over a floor or travelling surface at an elevation convenient to the child (17) who is training to walk. In engaging the apparatus (10), the child (17) is standing in a generally erect position. As the frame (11) is suspended over the child (17), the leg elements (13 & 14) are to either side of the child (17) at approximately the level of the elbow (23) of the child (17). The forearm and/or upper arm, where the upper arm joins the torso of the child (17), rest upon lower portions (20), which are generally horizontal components of the J-shaped leg elements (13 & 14). The top end element (30) of the leg element (13 & 14) is positioned to be within the grasp of the child (17). The suspended frame (11) defines a space which the child (17) occupies while using the apparatus (10) to permit movement of the child's upper torso and head within the space defined by the apparatus (11). The top (12) of the frame (11) is suspended in a position vertically superior to the body and the head of the child (17).

The upper body of the child (17) is generally positioned within the space defined by the frame (11), and the child's forearms (22) and elbows (23) extend to, or over, the surface of the lower portions (20) of leg elements (13 & 14).

The child (17) grips the elongated and generally vertical top end element (30) with his hands (24) and otherwise supports himself with his or her forearms (22) and upper arms (25) by leaning on the lower portion (30) of leg elements (13 & 14). In using this walking and training apparatus (10), the infant (17) initially employs his or her upper body strength to support himself within the frame (11). As the infant's legs, muscles and bones develop and become stronger and the child (17) learns to walk and improves his or her own standing and ambulatory skills, the apparatus (10) becomes less a suspension or a support means than a stabilizing means for the training child (17) until the child (17) is able enough to walk unattended or unassisted.

This invention, in certain aspects, minimizes the effort expended by the adult operator (16) associated with assisting infants and young children who are learning to walk. The rigid frame (11) extends not only the reach of the operator (16) to support the child (17), but because the frame (11) also extends around the body of the child (17), thereby providing support for the child (17), the operator (16) is able to maintain a preferred generally erect position while walking or standing. Furthermore, the frame (11) can be suspended by more than one operator (16) while a child (17) is learning to walk.

In one embodiment, as shown in FIGS. 1–4, the frame (11) in the disclosed invention is made of metal of and is rigid, yet pliable to the extent that the frame element (11) and the leg elements (13 & 14) can be bent for adjustment to accommodate the dimensions or requirements of a particular infant (17).

Figure 5:
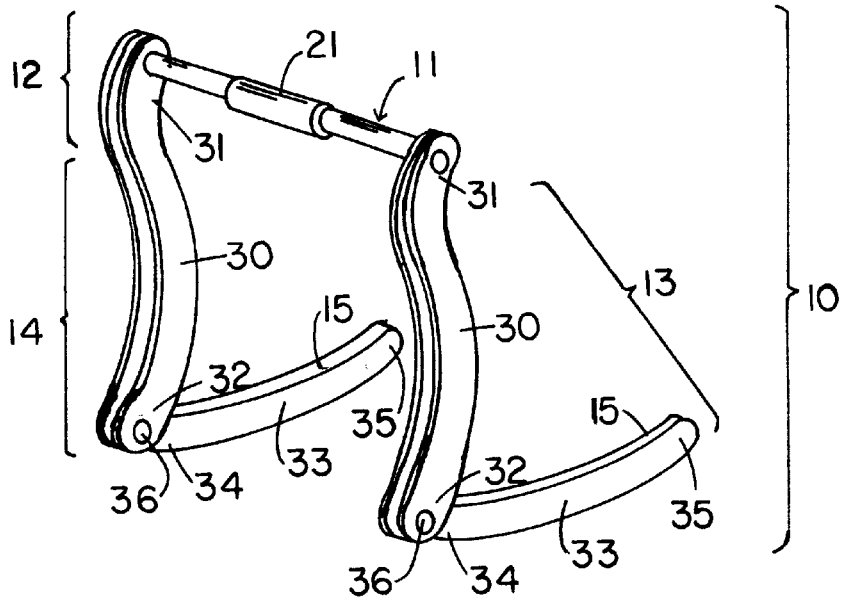
FIG. 5 is an oblique view of another embodiment of an infant walking and training apparatus according to the present invention showing folding leg elements.

In another embodiment of the invention, as shown in FIG. 5, each J-shaped leg element (13 & 14) comprises a separate elongated and generally vertical top end element (30) with a top (31) and a bottom (32) and a corresponding separate generally horizontal curved bottom end element (33). The separate generally horizontal curved bottom end element (33) has a front end (34) and a rear end (35). The front end (34) of the corresponding separate generally horizontal curved bottom end element (33) of each J-shaped leg element (13 & 14) is pivotally attached, by an attachment means (36) such as a hinge or pin, to the bottom (32) of elongated and generally vertical top end element (30). Each separate generally horizontal curved bottom end element (33) folds into the elongated and generally vertical top end element (30) of each J-shaped leg element (13 & 14).

Figure 6:
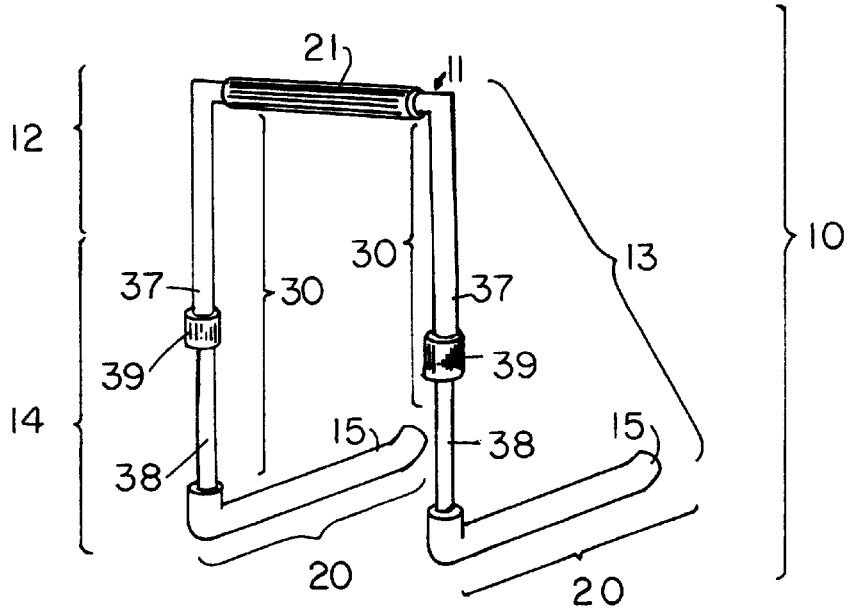
FIG. 6 is an oblique view of another version of an infant walking and training apparatus according to the present invention showing extensible and retractable leg elements to accommodate the differing heights of both operators and children.

In another embodiment of the invention, as shown in FIG. 6, the elongated top end element (30) of each J-shaped leg element (13 & 14) is extensible. A first shaft (37) works in union with a movable second shaft (38), which second shaft (38) fits into and moves within the first shaft (37). A fastener (39) secures the first shaft (37) and the second shaft (38) together to adjust the length of the elongated top end element (30) of each J-shaped leg element (13 & 14).

Figure 7:
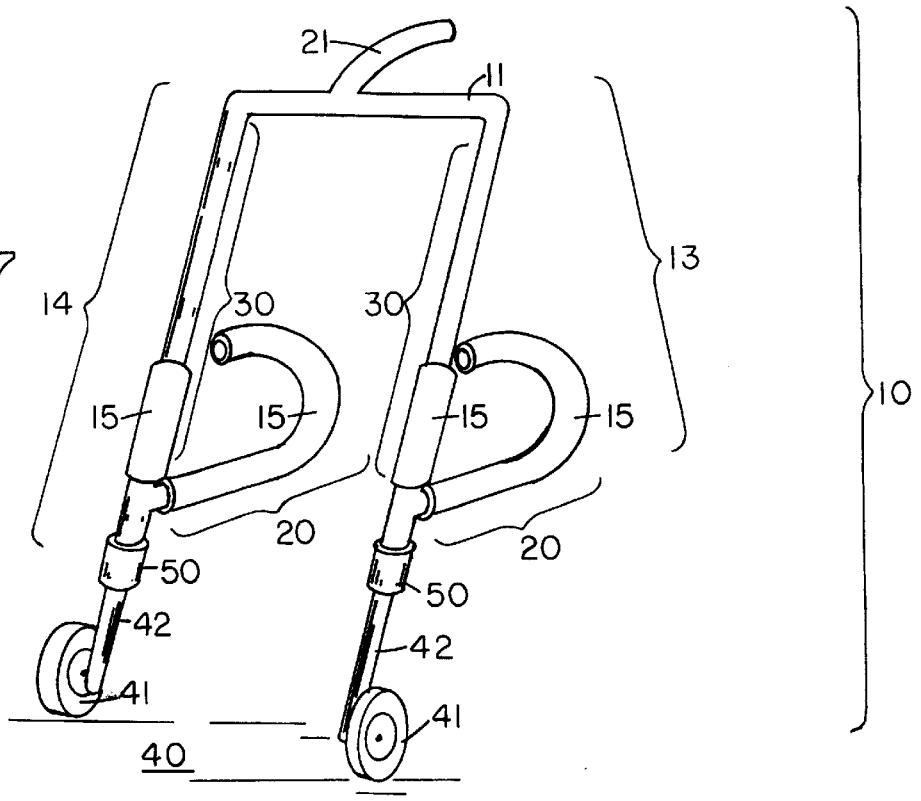
FIG. 7 is an oblique view of another embodiment of an infant walking and training apparatus according to the present invention showing an extension member connected to the J-shaped leg element for resting the apparatus on the traveling surface.

In another embodiment of the invention, as shown in FIG. 7, is an apparatus (10) for assisting and training a child to walk which includes a frame (11) with a first end, a second end and a middle section, at least one J-shaped leg element (13 & 14), each leg element (13 & 14) with an elongated and generally vertical top end element (30) and a lower portion (20). The elongated and generally vertical top end element (30) of the least one J-shaped leg element (13 & 14) is attached to an end of the frame element (11). At least one extension member (42), with an upper end and a lower end, is connected at its upper end to, and extends from, the at least one J-shaped leg element (13 & 14), whereby the at least one extension member (42) slides into the elongated and generally vertical top end element (30). A fastener (50) secures the at least one extension member (42) and the elongated and generally vertical top end element (30) together to adjust the height of the lower portion (20) of leg elements (13 & 14) from a travelling surface (40). At least one wheel (41), with a plane of rotation parallel to the at least one J-shaped leg element (13 & 14), is rotatably attached to the lower end of the at least one extension member (42). The at least one wheel provides for resting or rolling the apparatus (10) on the traveling surface (40). The embodiment of the invention in FIG. 7 displays a variation of the handle or grip (21) which extends from the frame (11); furthermore, FIG. 7 displays a variation of the lower portion (20) of the leg element (13 & 14) as having a nearly closed loop.

Figure 8:
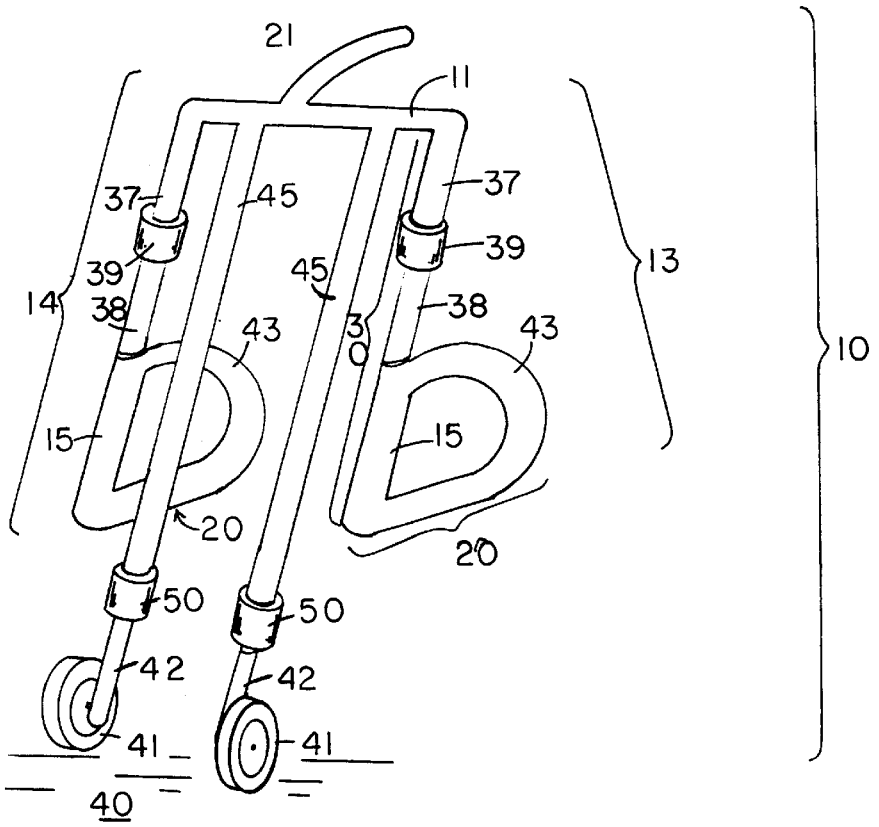
FIG. 8 is an oblique view of another version of an infant walking and training apparatus according to the present invention showing the extension member connected to the frame element.

In another embodiment of the invention, as shown in FIG. 8, is an apparatus (10) for assisting and training a child to walk which includes a frame (11) with a first end, a second end and a middle section, and at least one J-shaped leg element (13 & 14) with an elongated top end element (30) and a lower portion (20). A first shaft (37) works in union with a movable second shaft (38), which second shaft (38) fits into and moves within the first shaft (37). A fastener (39) secures the first shaft (37) and the second shaft (38) together to adjust the length of the elongated top end element (30) of each J-shaped leg element (13 & 14) in order to accommodate the height of the child (17) or the body length or leg length of the child (17). In this embodiment, lower portion (20) is a closed loop (43). The elongated and generally vertical top end element (30) is attached to an end of the frame (11). At least one frame extension member (45), with an upper end and a lower end, is connected at its upper end to, and extends from, the frame (11), whereby at least one extension member (42) slides into the at least one frame extension member (45). A fastener (50) secures the at least one extension member (42) and the at least one frame extension member (45) together to adjust the height of the frame (11) relative to a travelling surface (40). At least one wheel (41), with a plane of rotation parallel to the at least one J-shaped leg element (13 & 14), is rotatably attached to the lower end of the at least one extension member (42). The at least one wheel provides for resting or rolling the apparatus (10) on the traveling surface (40).

Figure 9:
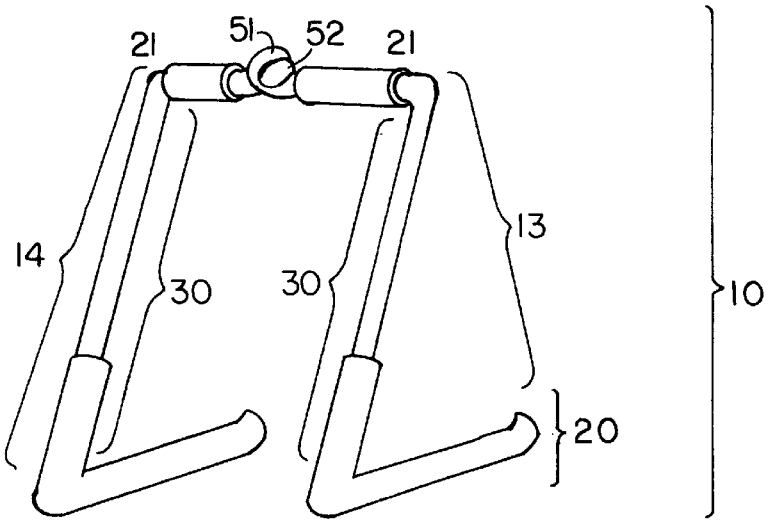
FIG. 9 is an oblique view of another embodiment of an infant walking and training apparatus according to the present invention showing hooked leg elements.

In another embodiment of the invention, as shown in FIG. 9, is an apparatus (10) for assisting and training a child to walk including a first J-shaped leg element (13), with an elongated and generally vertical top end element (30) with a first engagement portion (51) and a lower portion (20) for positioning beneath a first arm (25) of a child (17), and a second J-shaped leg element, (14) with an elongated and generally vertical top end element (30) with a second engagement portion (52) for releasably engaging the first engagement portion (51) and a lower portion (20) for positioning beneath a second arm (26) of the child (17) wherein the first engagement portion (51) and the second engagement portion (52) are hooks.

Figure 10:
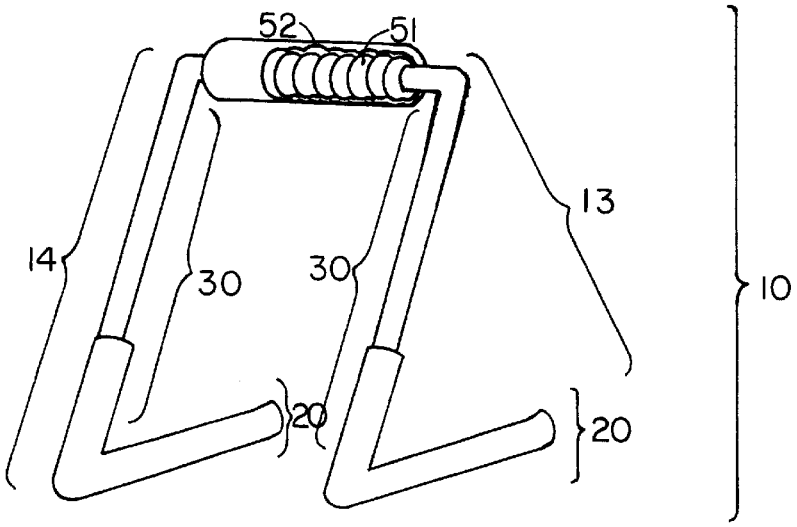
FIG. 10 is an oblique view of another version of an infant walking and training apparatus according to the present invention showing threaded engagement portions.

In another embodiment of the invention, as shown in FIG. 10, is an apparatus (10) for assisting and training a child to walk including a first J-shaped leg element (13), with an elongated and generally vertical top end element (30) with a first engagement portion (51) and a lower portion (20) for positioning beneath a first arm (25) of a child (17), and a second J-shaped leg element, (14) with an elongated and generally vertical top end element (30) with a second engagement portion (52) for releasably engaging the first engagement portion (51) and a lower portion (20) for positioning beneath a second arm (26) of the child (17) wherein the first engagement portion (51) is a threaded male portion to mate with the second engagement portion (52) which is the threaded female portion to receive the first engagement portion (51).

Figure 11:
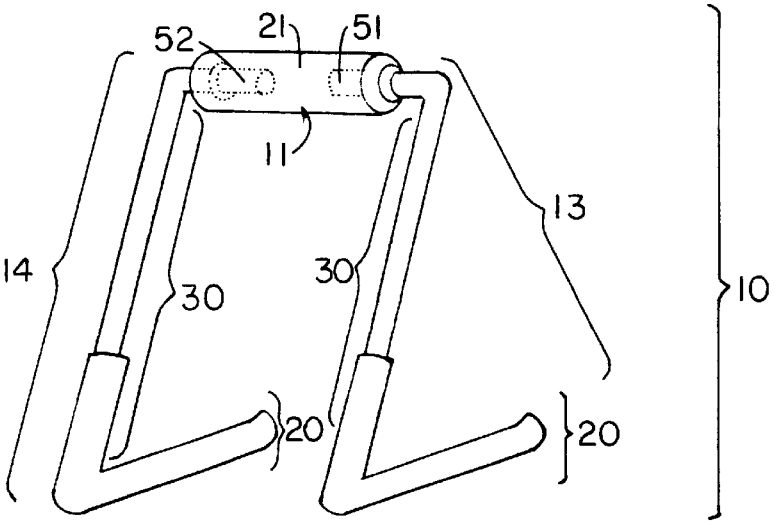
FIG. 11 is an oblique view of another version of an infant walking and training apparatus according to the present invention showing non-threaded engagement portions.

In another embodiment of the invention, as shown in FIG. 11, is an apparatus (10) for assisting and training a child to walk including a first J-shaped leg element (13), with an elongated and generally vertical top end element (30) with a first engagement portion (51) and a lower portion (20) for positioning beneath a first arm (25) of a child (17), and a second J-shaped leg element, (14) with an elongated and generally vertical top end element (30) with a second engagement portion (52) and a lower portion (20) for positioning beneath a second arm (26) of the child (17). The first engagement portion (51) and the second engagement portion (52) each releasably engages and attaches to and mates with the ends of the frame (11) or handle or grip (21).

I claim:

1. A portable, hand-held apparatus allowing an operator to assist and train a person in traversing across a traveling surface, the apparatus comprising:

a frame element with a first end, a second end, a top section, and a middle section;

the top section including a handgrip portion adapted to be grasped manually by the operator to manually suspend and support the frame element in an operating position above the traveling surface; and two, parallel J-shaped leg elements, each with an elongated top end occupying a generally common plane with the top section of the frame element and a curved bottom end extending in a plane generally perpendicular to the plane in which the two elongated top ends occupy, the elongated top end of each J-shaped leg element being attached to a respective first or second end of the frame element, said J-shaped leg elements being separate and spaced apart from each other, configured and disposed for providing underarm support for a person, wherein the operator grasps the handgrip portion to suspend and support the apparatus and the person is supported under ther arms by the curved bottom ends enabling the operator to assist and train the person in traversing across the traveling surface.

2. The apparatus of claim 1 wherein the curved bottom end of at least one J-shaped leg element is a closed loop.

3. The apparatus of claim 1 wherein the curved bottom end of at least one J-shaped leg element is a nearly closed loop.

4. The apparatus of claim 1 further comprising at least one extension member connected to and extending from at least one J-shaped leg element, the at least one extension member for contacting the traveling surface for resting the apparatus on the traveling surface.

5. The apparatus of claim 1 further comprising at least one extension member connected to and extending from the frame element, the at least one extension member for contacting the traveling surface for resting the apparatus on the traveling surface.

6. The apparatus of claim 1 with at least one handle located along the middle section of the frame element and extending therefrom.

7. The apparatus of claim 1 wherein the elongated top end and curved bottom end of each J-shaped leg element comprises a separate elongated generally vertical top end element with a top and a bottom and a separate generally horizontal curved bottom end element with a front end and a rear end, the front end of the separate generally horizontal curved bottom end element of the J-shaped leg element pivotally attached to the bottom en of the separate elongated generally vertical top end element, and the separate genreally horizontal curved bottom end element of the J-shaped leg element foldable into the separate elongated generally vertical top end element.

8. The apparatus of claim 1 wherein the elongated top end of each J-shaped leg element is extensible and comprises a first shaft, a movable second shaft which fits into and moves within the first shaft, and a means to secure the first shaft and the second shaft together to alter the length of the elongated top end of the J-shaped leg element.

9. The apparatus of claim 1 wherein each J-shaped leg element has an exterior surface and wherein an impact-absorbing material lines the exterior surface of each J-shaped leg element.

10. The apparatus of claim 1 wherein each J-shaped leg element has an exterior surface and wherein an imapct-absorbing material lines the exterior surface of the curved bottom end of each J-shaped leg element.

11. The apparatus of claim 1 wherein the frame element defines a space to permit movement of the person's upper torso and head within the space defined by the apparatus.

12. The apparatus of claim 1 wherein the first end of the frame element and the second end of the frame element are releasably connected by first and second engagement portions.

13. The apparatus of claim 12 wherein the first engagement portion and the second engagement portion are hooks.

14. The apparatus of claim 12 wherein the first engagement portion is threaded to receive and mate with the second engagement portion which is also threaded.

15. A method for training a child to walk, the method comprising:

positioning the child in contact with an apparatus for assisting and training a child to walk, said apparatus comprising a frame element with a first end, a second end, a top section, and a middle section; the top section including a handgrip portion adapted to be grasped manually by an operator to manually suspend the frame element below the operator's hand, and two J-shaped leg elements, each with an elongated top end and a curved bottom end, the elongated top end of each J-shaped leg element being attached to a respective first or second end of the frame element, said J-shaped leg elements being separate and spaced apart from each other, configured and disposed for providing underarm support for a child;

the operator suspending the frame over the head of the child and around the body of the child to permit movement of the child's upper torso and head within the space defined by the apparatus so that the elongated top end of each J-shaped leg element is adjacent to one of the child's hands, and the curved bottom end of each J-shaped leg element is beneath the forearms and upper arms of the child; and placing the hands of the child on the apparatus, the child supporting itself with its forearms and upper arms, the child leaning on at least one J-shaped leg element while attempting to walk.

* * * * *